US009403098B1

(12) United States Patent
Haisman

(10) Patent No.: US 9,403,098 B1
(45) Date of Patent: Aug. 2, 2016

(54) POLYGONAL SWING ASSEMBLY

(71) Applicant: Paul Haisman, Wheeling, IL (US)

(72) Inventor: Paul Haisman, Wheeling, IL (US)

(73) Assignee: Paul Haisman, Wheeling, IL (US)

( * ) Notice: Subject to any disclaimer, the term of this patent is extended or adjusted under 35 U.S.C. 154(b) by 0 days.

(21) Appl. No.: 14/739,655

(22) Filed: Jun. 15, 2015

Related U.S. Application Data

(60) Provisional application No. 62/137,439, filed on Mar. 24, 2015.

(51) Int. Cl.
*A63G 9/00* (2006.01)
*A63B 9/00* (2006.01)

(52) U.S. Cl.
CPC ..... *A63G 9/00* (2013.01)

(58) Field of Classification Search
CPC ..... A63G 9/00; A63G 9/02; A63G 9/04; A63G 9/12; A63G 9/20; A63G 21/00; A63B 9/00; A47D 11/00
USPC ..... 472/116, 118–125; 482/35, 36; 297/273, 274, 276
See application file for complete search history.

(56) References Cited

U.S. PATENT DOCUMENTS

| | | | | | |
|---|---|---|---|---|---|
| 1,729,529 | A * | 9/1929 | Winton | A63G 9/20 | 297/244 |
| 3,130,969 | A * | 4/1964 | Groth | A63G 9/02 | 297/273 |
| 3,643,942 | A * | 2/1972 | Williams | A47D 11/00 | 248/370 |
| 4,084,812 | A * | 4/1978 | Melrose | A63B 9/00 | 273/348 |
| 8,616,639 | B2 * | 12/2013 | Britz, Jr. | A63G 9/12 | 297/273 |
| 2012/0316038 | A1 * | 12/2012 | Beckwith | A63G 21/00 | 482/35 |

* cited by examiner

*Primary Examiner* — Kien Nguyen
(74) *Attorney, Agent, or Firm* — Miller, Matthias & Hull LLP

(57) ABSTRACT

Swing assemblies and systems for providing unique user experiences are disclosed. The swing assemblies may include a polygonal base, a plurality of vertical support beams and a plurality of swings. Each of the plurality of swings being attached to optional horizontal beams or to the vertical support beams. The swing assemblies further include a plurality of outer wing structures, each of the outer wing structures associated with one of the plurality of vertical beams and each of the outer wing structures extending radially outward of its respective associated vertical beam. In some examples, the swing assemblies may include a rotating assembly or an elastic resistance device to further add to the user experience.

20 Claims, 8 Drawing Sheets

POLYGONAL SWING ASSEMBLY

This application claims the 35 U.S.C. §119(e) benefit of U.S. Provisional Application No. 62/137,439, filed on Mar. 24, 2015, which is herein incorporated by reference in its entirety for all that it teaches and discloses, without exclusion of any part thereof.

TECHNICAL FIELD

The present disclosure generally relates to amusement assemblies and, more particularly, relates to polygonal swing assemblies and systems.

BACKGROUND

Amusement assemblies, such as swing sets and other assemblies found, generally, in a park or playground, are used to entertain or amuse users when the users physically interact with the assemblies. For example, playgrounds often employ, among other assemblies, swing set assemblies, climbing structures, merry-go-rounds, rocking structures, and the like, for user amusement and play for all ages.

The users of such equipment are generally children and youth, therefore, design of such amusement structures present unique opportunities. First, amusement equipment aims to optimize user experience and entertainment, so that the user wants to continue to use the equipment. Memorable and fun user experiences may entice the user to return to the site of the equipment for more use and/or may lead the user to suggest that their friends or family visit the park. Such popularity of the equipment may entice other entities (e.g., municipal parks, private parks, families, etc.) to purchase similar equipment to entertain users on their respective properties.

However, amusement is not the only aim during the design of such equipment; safety is also an important factor in design. Even if a piece of equipment provides a thrilling user experience, it may not be appropriate in amusement situations if important safety considerations are not considered reducing the likelihood of the risk of injury to the user under normal recommended operating conditions. Additionally, amusement equipment may have to pass safety standards set by federal government regulations (e.g., regulations set forth by the United States Consumer Product Safety Commission), state regulations, provincial regulations, county regulations, city regulations, and/or any other government regulations. To that end, it is desired to design and create amusement equipment that optimizes user experience and enjoyment while maintaining a safe experience for the user and surrounding environment.

This Background section represents the inventor's thoughts and observations and is not intended to fully or accurately summarize any prior art reference or practice. As such, the observations in this section are expressly disclaimed as prior art.

SUMMARY

Based on the foregoing, the inventor has discovered that polygonal swing assemblies may provide for a unique, desirable and safe user experience. In accordance with one aspect of the disclosure, a swing assembly is disclosed. The swing assembly may include a base having at least three sides and defining a plurality of vertices and a center point, the plurality of vertices located at points where two of the at least three sides meet. The swing assembly may further include a plurality of vertical support beams, each of the plurality of vertical support beams having a first end and a second end, the first end being connected to the base at one of a plurality of support beam locations, the support beam locations being in proximate alignment with one of the plurality of vertices and the center point. The swing assembly may further include a plurality of horizontal support beams, each of the plurality of horizontal support beams extending from and connected to the second end of a member of the plurality of support beams to the second end of another member of the plurality of support beams. The swing assembly may further include a plurality of swings, each of the plurality of swings being attached to one of the plurality of horizontal beams. The swing assembly may further include a plurality of outer wing structures, each of the outer wing structures associated with one of the plurality of vertical beams, each of the outer wing structures extending radially outward of its respective associated vertical beam and connected to the base at a one of a plurality of wing locations, the wing locations being in proximate alignment with one of the plurality of vertices and the center point and located radially outward of the support beam location of the respective member of the plurality of vertical beams with which each outer wing structure is associated.

In accordance with another aspect of the disclosure, another swing assembly is disclosed. The swing assembly may include a plurality of base structures, each of the plurality of base structures connected to a ground surface and positioned radially outward of a center point at a respective radial distance from the center point, each of the respective radial distances being substantially similar, and each of the plurality of base structures positioned substantially circumferentially equidistant from one another. The swing assembly may further include a plurality of vertical beams, each of the plurality of vertical beams having a first end and a second end, the first end being connected to one of the plurality of base structures. The swing assembly may further include a plurality of horizontal beams, each of the plurality of horizontal beams extending from and connected to the second end of a member of the plurality of vertical beams to the second end of another member of the plurality of vertical beams. The swing assembly may further include a plurality of swings, each of the plurality of swings being attached to one of the plurality of horizontal beams. The swing assembly may further include a plurality of outer wing structures, each of the outer wing structures associated with one of the plurality of vertical beams, each of the outer wing structures extending radially outward of its respective associated vertical beam.

In accordance with yet another aspect of the disclosure, yet another swing assembly is disclosed. The swing assembly may include a base having at least three sides and defining a plurality of vertices and a center point, the plurality of vertices located at points where two of the at least three sides meet. The swing assembly may further include a plurality of vertical support beams, each of the plurality of vertical support beams having a first end and a second end, the first end being connected to the base at one of a plurality of support beam locations, the support beam locations being in proximate alignment with one of the plurality of vertices and the center point. The swing assembly may further include a plurality of swings, each of the plurality of swings being attached to two of the plurality of vertical beams. The swing assembly may further include a plurality of outer wing structures, each of the outer wing structures associated with one of the plurality of vertical beams, each of the outer wing structures extending radially outward of its respective associated vertical beam and connected to the base at a one of a plurality of wing locations, the wing locations being in proximate alignment with one of the plurality of vertices and the center point and located radially outward of the support beam location of the respective member of the plurality of vertical beams with which each outer wing structure is associated.

While the following detailed description will be given with respect to certain illustrative embodiments, it should be understood that the drawings are not necessarily to scale and the disclosed embodiments are sometimes illustrated diagrammatically and in partial views. In addition, in certain instances, details which are not necessary for an understanding of the disclosed subject matter or which render other details too difficult to perceive may have been omitted. It should therefore be understood that this disclosure is not limited to the particular embodiments disclosed and illustrated herein, but rather to a fair reading of the entire disclosure and claims, as well as any equivalents thereto.

DETAILED DESCRIPTION

Figure 1:
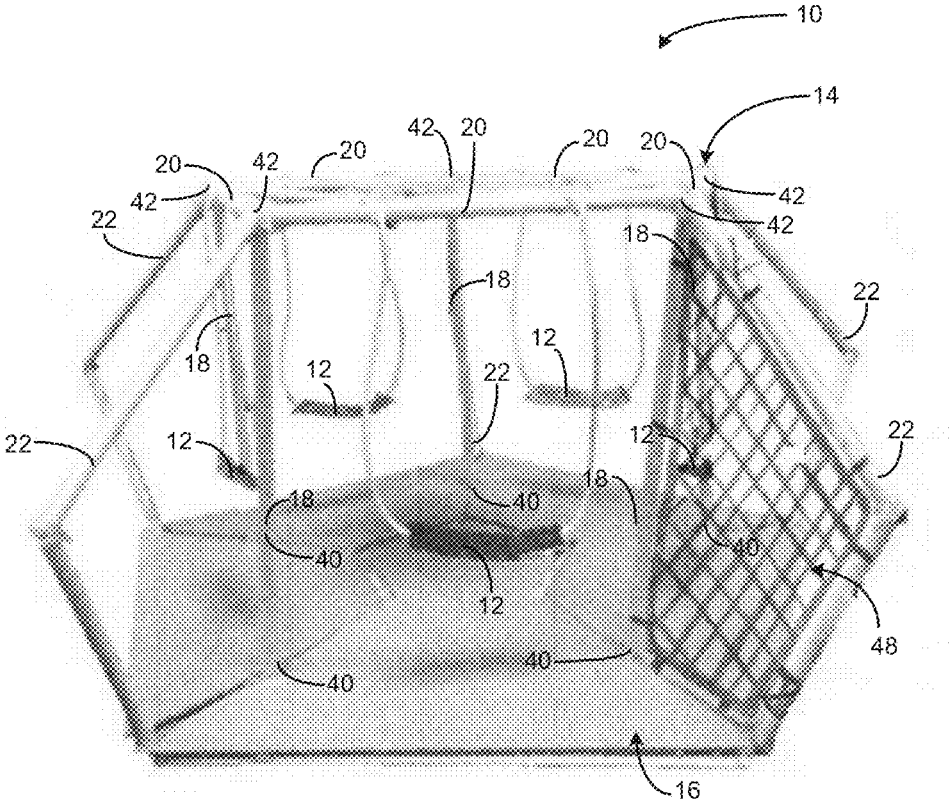
FIG. 1 is an angled perspective view of a polygonal swing assembly, in accordance with an embodiment of the disclosure.
Figure 2:
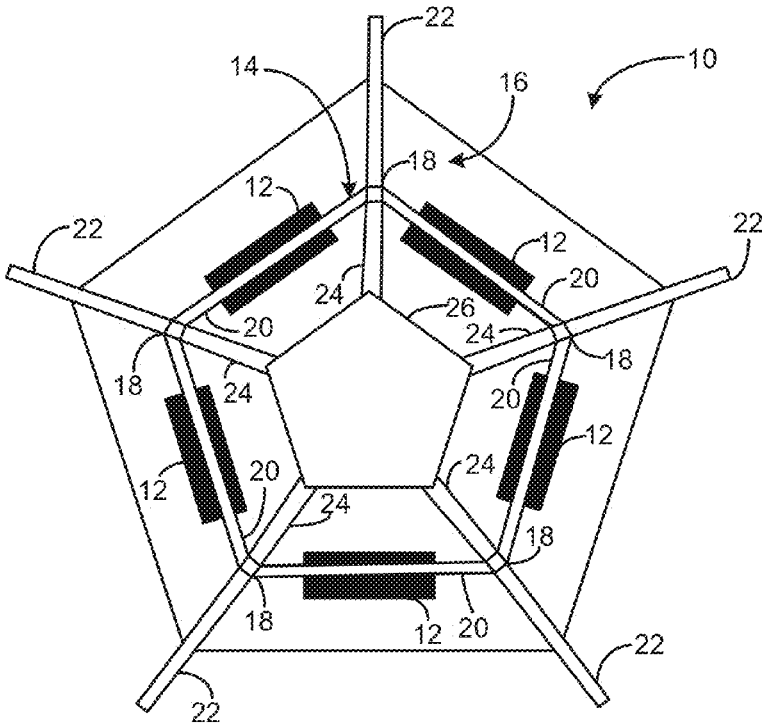
FIG. 2 is a top view of the polygonal swing assembly of FIG. 1, in accordance with the embodiment of FIG. 1 and the present disclosure.

Turning now to the drawings, and with specific reference to FIGS. 1 and 2, a swing assembly 10 is shown. The swing assembly 10 may include swings 12 which are hung from, or otherwise attached to, a swing structure 14 which is affixed to a base 16. While five swings 12 are shown in the example embodiment of FIG. 1, any number of swings 12 may be used. The swing structure 14 includes vertical beams 18, horizontal beams 20, and outer wing structures 22. In some examples, the swing structure 14 may include additional structures, for further structural support, such as the overhead beams 24 and center support 26, as shown in FIG. 2.

Figure 3:
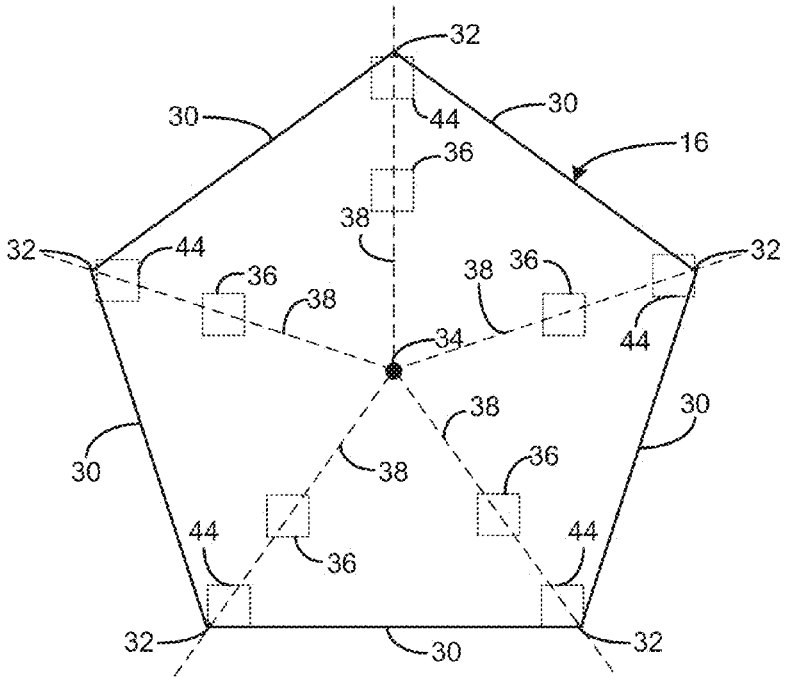
FIG. 3 is a top view of a base of the polygonal swing assembly of FIGS. 1 and 2, not showing other elements of the polygonal swing assembly, in accordance with FIGS. 1 and 2 and the present disclosure.

Referring now to FIG. 3, and with continued reference to FIGS. 1 and 2, the base 16 is shown and the depiction of FIG. 3 shows exemplary points and locations on the base 16 to which the swing structure 14 may be affixed to the base 16. The base 16 has a generally polygonal shape which may be defined by sides 30. While the depiction of FIGS. 1-3 show the base 16 having five sides 30, the base 16 may have any number of sides 30, so long as there are at least three sides 30 and the shape of the base 16 forms a polygon. The points on the polygonal shape of the base 16 at which two of the at least three sides 30 meet are defined as vertices 32 of the base 16.

The polygonal shape of the base 16 may be centered on a center point 34. Using alignment with one or both of the center point 34 and the vertices 32, the swing structure 14 may be positioned atop the base 16. Each of the vertical beams 18 may be positioned in proximate alignment with the center point 34 and one of the vertices 32; these positioning locations for the vertical beams 18 are depicted in FIG. 3 by the beam locations 36. FIG. 3 further shows alignment lines 38, which each extend from the center point 34 to one of the plurality of vertices 32. As shown, each of the beam locations 36 may be proximately located along one of the lines 38.

A first end 40 of each of the vertical beams 18 may each be attached to the base 16 proximate to one of the beam locations 36. Each of the vertical beams 18 may extend vertically to a second end 42. Horizontal beams 20 may be attached to one second end 42 of one of the vertical beams 18 and to another second end 42 of another of the vertical beams 18. The swings 12 may each hang from one of the horizontal beams 20 and also be attached to one of the horizontal beams 20.

Further, the outer wing structures 22 of the swing structure 14 are provided and are each associated with one of the vertical beams 18. Each of the outer wing structures 22 extend radially outward of their respective vertical beams 18. While depicted as a five sided polygon in FIGS. 1-2, each of the outer wing structures 22 may have any shape, so long as it extends radially outward from one of the vertical beams 18. The outer wing structures 22 may also be connected to the base 16 at one of a plurality of wing locations 44. The wing locations 44 may be positioned in proximate alignment with the center point 34 and one of the vertices 32 (e.g., on one of the lines 38) and may be positioned radially outward from one of the beam locations 36. In other words, each of the wing locations 44 may share a line 38 with one of the beam locations 36 and the wing location 44 may be positioned radially outward, on the line 38, of its respective beam location 36. In some examples, the outer wing structure 22 may attach to the base 16 proximate to the beam location 36 of its respective vertical beam 18.

The outer wing structures 22 may provide a variety of benefits when used as part of the swing structure 14. For example, as shown in FIG. 1, two of the outer wing structures 22 may combine to create a bay enclosure 46 for one of the swings 12. Using the outer wing structures 22 to create one or more bay enclosures 46 may provide an enclosure for a user on one of the swings 12 that prevents other users on other swings 12 of the swing assembly 10 from colliding. Additionally, due to the radially outward extension of the outer wing structures 22, the outer wing structures 22 may prevent non-using bystanders from being struck by a user of one of the swings 12, while the swing assembly 10 is being used. As such, the outer wing structures 22 may create a physical barrier in front or in back of a swing 12 as it moves by designing the amount of radial protrusion of the outer wing structures 22 based on characteristics of the swings 12. The outer wing structures 22, in some examples, may include a netting 48 or other barrier that prevents passage through the outer wing structures 22.

Figure 4:
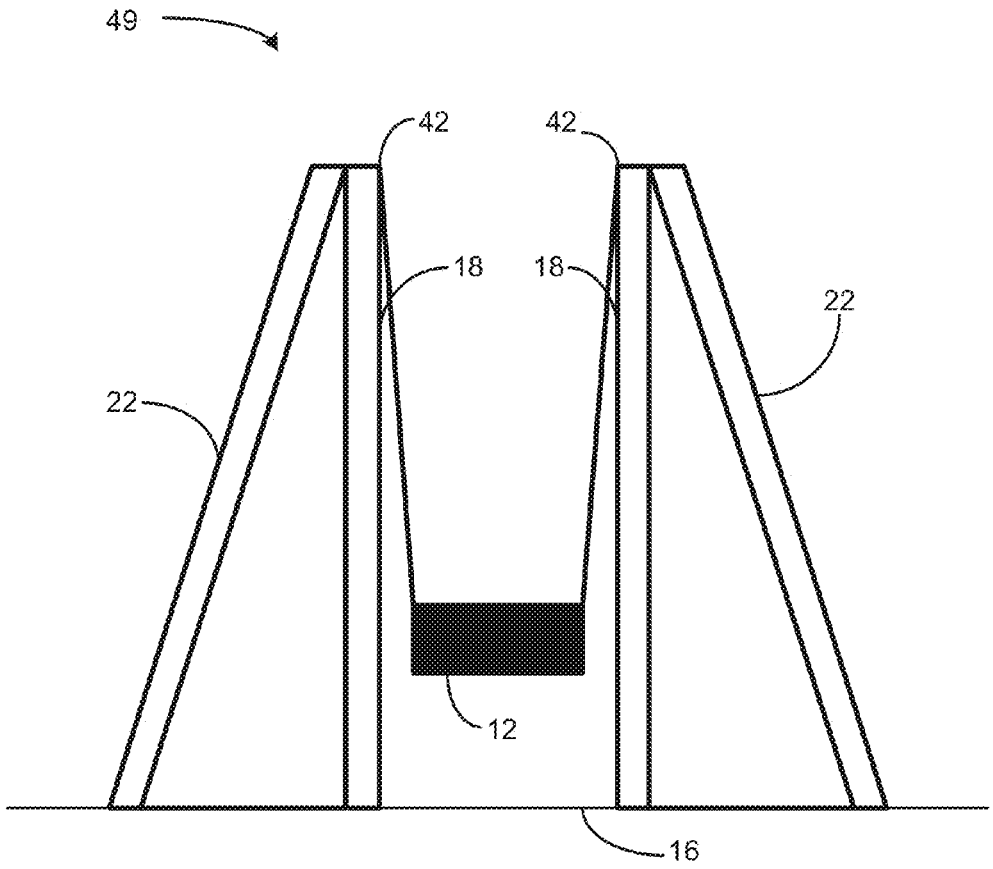
FIG. 4. is a side view of an example swing arrangement for use with the swing assembly of FIGS. 1-3, wherein a horizontal beam is not present and the swing attaches to vertical beams, in accordance with an embodiment of the disclosure.

In some examples, one or more of the swings 12 may be arranged in accordance with the swing arrangement 49 shown in FIG. 4. In such examples, the swing 12 may be attached to two of the vertical beams 18. The swings 12 may attach to the swing structure 14, in these examples, proximate to the second ends 42 of the corresponding vertical beams 18. By attaching the swing 12 to the vertical beams 18, horizontal beams may not be necessary in the swing arrangement 49.

Figure 5:
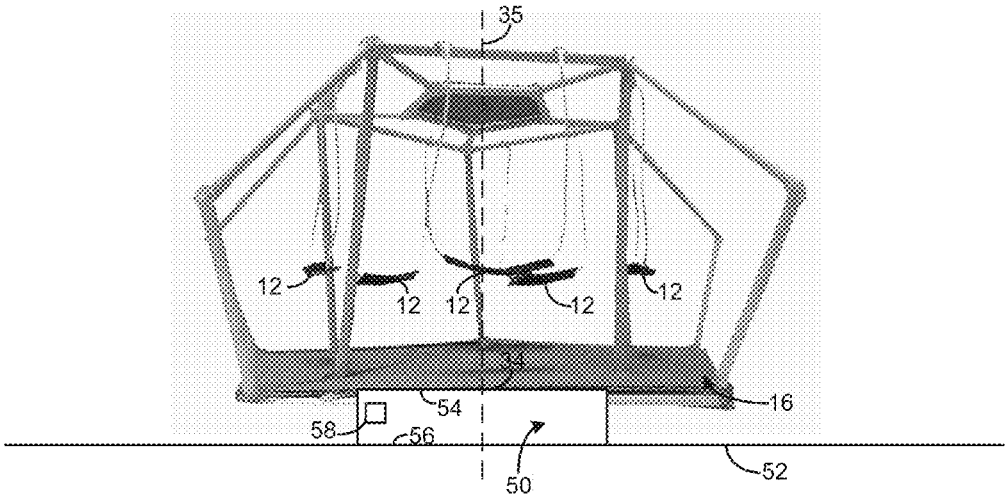
FIG. 5 is a side view of the polygonal swing assembly of FIGS. 1-3, further including a rotating structure affixed thereto, in accordance with an embodiment of the disclosure.

FIGS. 5-9 show a variety of different features that may be included, in conjunction with the embodiment of FIGS. 1-3, with the swing assembly 10. FIG. 5 shows the swing assembly 10 further including a rotating assembly 50 attached to both the base 16 and a ground surface 52. The rotating assembly 50 may attach to the base 16 at a top end 54 of the rotating assembly 50 and may attach to the ground surface 52 at a bottom end 56 of the rotating assembly 50. The rotating assembly 50 may be any means for rotating the base 16 and, in turn, rotating the swing assembly 10 and the users when in use. The rotating assembly 50 may cause the base 16 to rotate similar to a conventional playground merry-go-round, but while users are on the swings 12. Rotation of the rotating assembly 50 may be performed about a center axis 35, which may be defined as a vertical axis through the center point 34 and substantially perpendicular to the ground surface 52. The rotating assembly 50 may provide a unique user experience, because it enables the swing assembly 10 to rotate while users swing on the swings 12. Further, to limit the rotational speed of the rotating assembly 50 to safe speeds, the swing assembly 10 may include a speed governor, gear assembly, or similar 58 associated with the rotating assembly 50.

Figure 6:
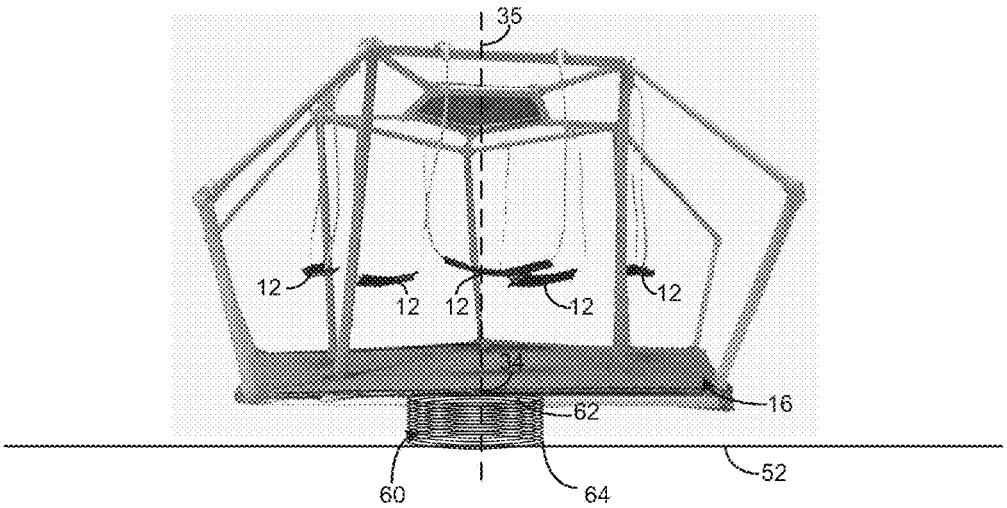
FIG. 6 is a another side view of the polygonal swing assembly of FIGS. 1-3, further including an elastic resistance device affixed thereto, in accordance with an embodiment of the disclosure.
Figure 7:
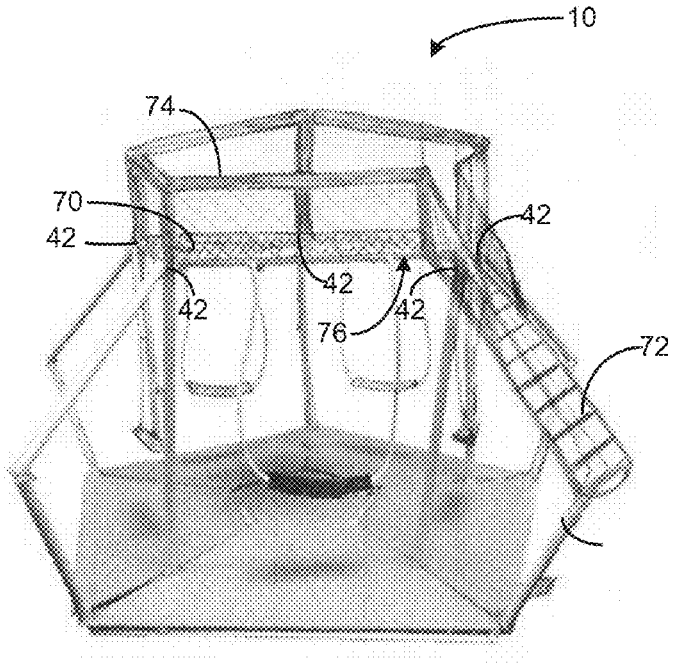
FIG. 7 is an angled perspective view of the polygonal swing assembly of FIGS. 1-3, further including additional features, in accordance with an embodiment of the disclosure.

Turning now to FIG. 6, and with continued reference to FIGS. 1-3, an example of the swing assembly 10 is shown that further includes an elastic resistance device 60 disposed between the base 16 and the ground surface 52. The elastic resistance device 60 may be any elastic mechanical device that stores mechanical energy (e.g., a spring, hydraulic action, or the like that exerts a force approximately proportional to changes in its length). The elastic resistance device 60 may be attached to the base 16 at a top end 62 of the elastic resistance device 60 and may be attached to the ground surface 52 at a bottom end 64 of the elastic resistance device 60. The elastic resistance device 60 may be attached to the base 16 at a location proximate to the center point 34. In alternative examples, the elastic resistance device 60 may include a plurality of elastic resistance devices 60, which may each be attached to the base 16. The locations in which such a plurality of elastic resistance device 60 may be attached to the base 16 may be locations in alignment with one of the plurality of vertices 32 and the center point 34.

By using the elastic resistance device 60, the swing assembly 10 may be able to rock, shift, sway, bounce, or otherwise move with respect to the ground surface 52. In providing this additional movement while users also use the swings 12, the swing assembly 10 may provide yet another unique user experience. Both the rotational capabilities of the rotating assembly 50 of FIG. 5 and the motion capabilities of the elastic resistance device 60 of FIG. 6 may provide amusement for a user and as a new, unique user experience.

Further still, FIG. 6 shows additional features that may be used in conjunction with any of the preceding examples of the swing assembly 10 and associated features of FIGS. 1-5. The example of FIG. 7 includes a ceiling structure 70 disposed above and attached to second ends 42 of the vertical beams 18. Additionally, the swing assembly 10 may include a plurality of steps 72 associated with one of the outer wing structures 22 which may form an accessibility structure (e.g., a ladder) to provide access to the ceiling structure 70. In some examples, a barrier structure 74 may be provided, which extends vertically upward from a perimeter 76 of the ceiling structure 70. By providing access to the ceiling structure 70, users may be able to climb to the top of the swing assembly 10 and reside atop the ceiling structure 70. This may provide a unique user experience for users, as they may be able to safely look down upon users swinging below or observe other surroundings from an elevated perch. Additionally, if used in conjunction with the features of FIG. 5 or 6, users atop the ceiling structure 70 may be amused due to experiencing the rotation of the rotating assembly 50 or the motion provided by the elastic resistance device 60. By including the barrier structure 74, a safe experience may be provided for the users atop the ceiling structure 70.

Figure 8:
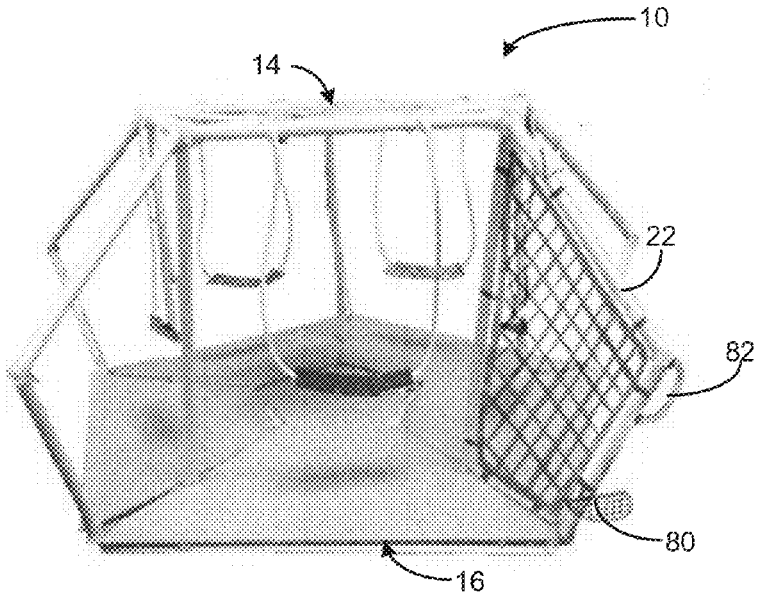
FIG. 8 is another angled perspective view of the polygonal swing assembly of FIGS. 1-3, further including additional features, in accordance with an embodiment of the disclosure.

FIG. 8 shows an example of the swing assembly 10 that further includes one or more standing platforms 80, protruding from the perimeter of the base 16 at a location proximate to one of the vertices 32. The standing platforms 80 may allow additional users to stand on the swing assembly 10 while other users use the swings 12. For example, if used in conjunction with the features of FIG. 5 or 6, users standing on the standing platforms 80 may be amused due to experiencing the rotation of the rotating assembly 50 or the motion provided by the elastic resistance device 60. Handles 82 may additionally be provided on the outer wing structures 22 so that users standing on the standing platforms 80 have something to hold on to. Use of one or both of the standing platforms 80 and/or the handles 82 may give a user a place to push or pull the swing assembly 10 (e.g., pushing or pulling the swing assembly 10 to spin the swing assembly (0 when the rotating assembly 50 is included).

Figure 9:
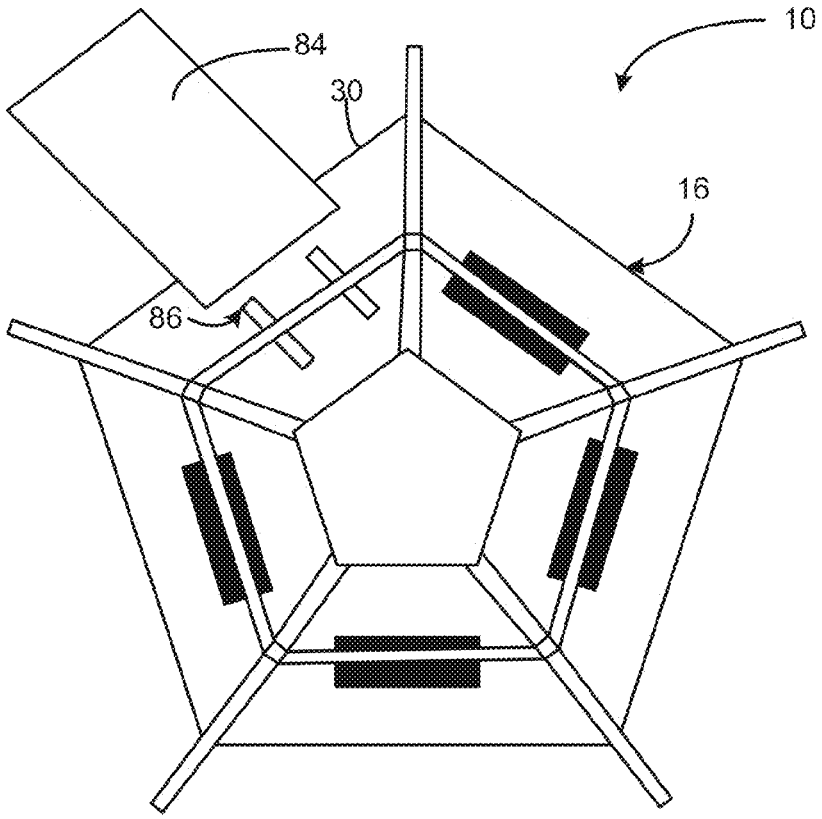
FIG. 9 is a top view of the polygonal swing assembly of FIGS. 1-3, further including accessibility features, in accordance with an embodiment of the disclosure.

To provide an even more inclusive amusement experience, the swing assembly 10 may include accessibility features for persons with disabilities as shown in FIG. 9. FIG. 9 shows the swing assembly 10 further including an accessibility ramp 84 associated with one of the sides 30 of the based 16. The accessibility ramp 84 may be a foldable ramp or ramp shelf that can fold down or slide outward to the ground surface 52 for a user to access the top of the base 16. Additionally, the swing assembly 10 may include a restraint system 86 that is configured to lock a wheelchair in a static position with respect to the base 16. For example, the restraint system 86 may include grooves on the base 16 that lock in wheels of a wheel chair. Additionally or alternatively, the restraint system 86 may include any combination of belts, chains, straps, or other means for restraining a wheelchair with respect to the base 16. If used in conjunction with the features of FIG. 5 or 6, the accessibility features of FIG. 9 may allow disabled persons to experience the rotation of the rotating assembly 50 or the motion provided by the elastic resistance device 60.

Figure 10:
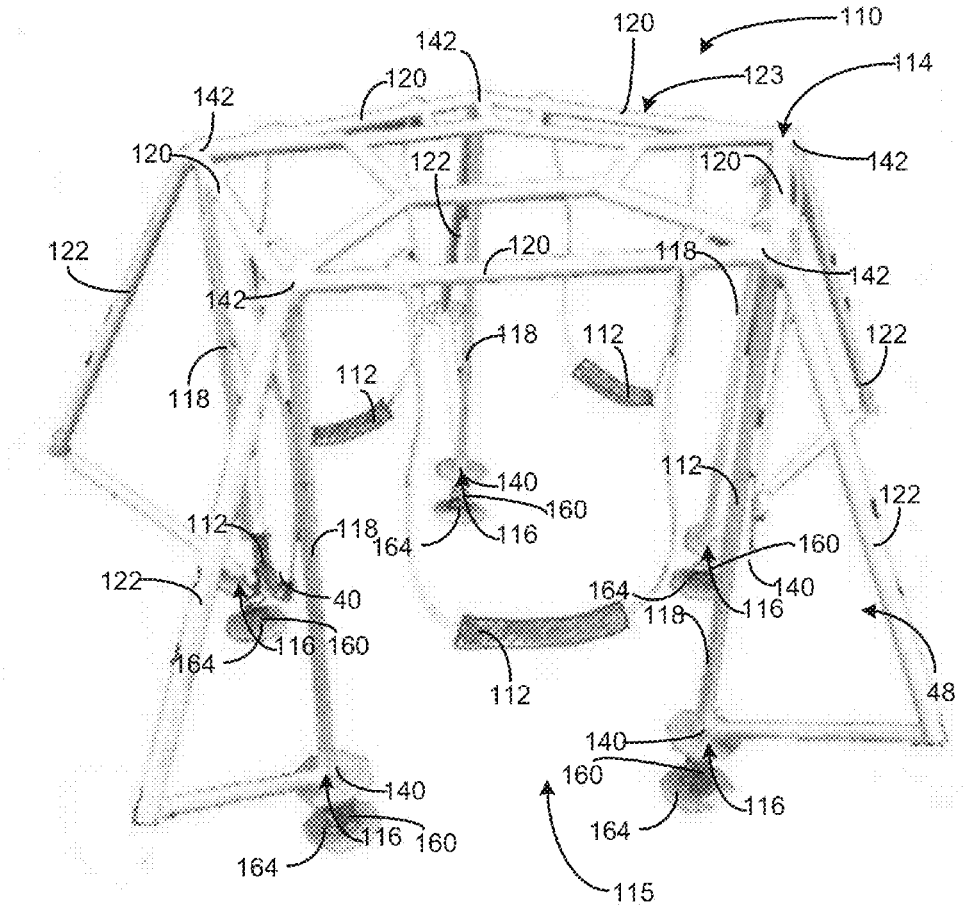
FIG. 10 is an angled perspective view of a polygonal swing assembly including a plurality of base structures, in accordance with another embodiment of the disclosure.
Figure 11:
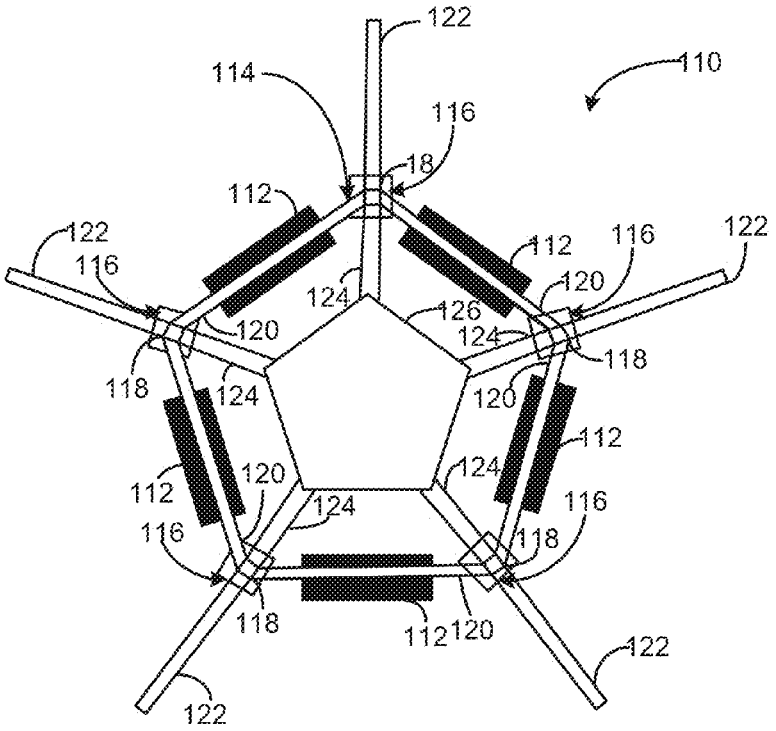
FIG. 11 is a top view of the polygonal swing assembly of FIG. 10, in accordance with the embodiment of FIG. 10 and the present disclosure.

Turning now to FIGS. 10 and 11, a swing assembly 110 is shown in another embodiment of the disclosure. The swing assembly 110 may include swings 112 which are hung from, or otherwise attached to, a swing structure 114 which is affixed to a ground surface 115 via a plurality of base structures 116. While five swings 112 are shown in the example embodiment of FIG. 9, any number of swings 112 may be used. The swing structure 114 includes vertical beams 118, horizontal beams 120, and outer wing structures 122. In some examples, the swing structure 114 may include additional structures for further structural support, such as the overhead beams 124 and center support 126.

Figure 12:
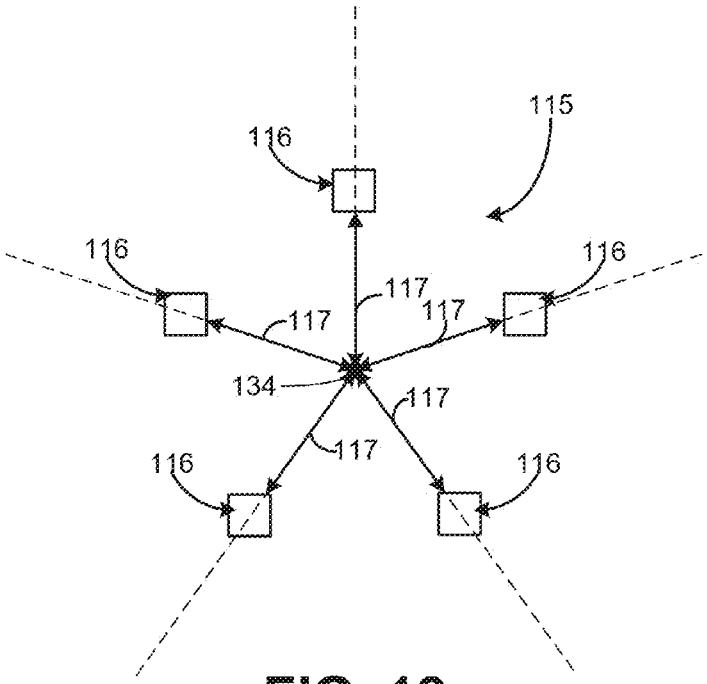
FIG. 12 is a top view of the plurality of base structures of the polygonal swing assembly of FIGS. 10-11, in accordance with FIGS. 10-11 and the present disclosure.

Referring now to FIG. 12 and with continued reference to FIGS. 10 and 11, the base structures 116 are shown and the depiction of FIG. 12 shows exemplary alignment and locations on the base structures 116. The swing structure 114 may be affixed to the ground surface 115 via the base structures 116 by, for example, connecting a first end 140 of each of the vertical beams 118 to one of the base structures 116. The base structures 116 may be positioned such that it allows the horizontal beams 120 to form a top polygonal shape 123. While the depictions of FIGS. 10-12 show five base structures 116, there may be any number of base structures 116, so long as there are at least three so that the top polygonal shape 123 has at least 3 sides.

The base structures 116 may be positioned radially outward of a center point 134 of the swing assembly 110. Each base structure 116 may be positioned at a radial distance 117 away from the center point 134, wherein each of the radial distances 117 is substantially similar in length. Additionally, as shown, the base structures 116 may be positioned substantially circumferentially equidistant from one another.

The first end 140 of each of the vertical beams 118 may each be attached to one of the base structures 116. Each of the vertical beams 118 may extend vertically to a second end 142. Horizontal beams 120 may be attached to one second end 142 of one of the vertical beams 118 and to another second end 142 of another of the vertical beams 118. The swings 112 may each hang from one of the horizontal beams 120 and also be attached to one of the horizontal beams 120.

Further, the outer wing structures 122 of the swing structure 114 are provided and are each associated with one of the vertical beams 118. Each of the outer wing structures 122 extend radially outward of their respective vertical beams 118. While depicted as triangles in FIG. 9, each of the outer wing structures 122 may have any shape, so long as it extends radially outward from one of the vertical beams 118. The outer wing structures 122 may also be connected to the same base structure 116 that its respective vertical beam 118 extends from. The outer wing structures 122, in some examples, may include netting or other barrier that prevents passage through the outer wing structures 122.

As best shown in FIG. 10, an example of the swing assembly 110 may include one or more elastic resistance devices 160 disposed between the base structures 116 and the ground surface 115. The elastic resistance devices 160 may be any elastic mechanical device that stores mechanical energy (e.g., a spring that exerts a force approximately proportional to changes in its length, a hydraulic resistance device, or any other elastic resistance device). The elastic resistance devices 160 may be attached to the base structures 116 at a top end 162 of each of the elastic resistance devices 160 and may be attached to the ground surface 115 at a bottom end 164 of each of the elastic resistance devices 160.

By using the elastic resistance devices 160, the swing assembly 110 may be able to rock, shift, sway, bounce, or otherwise move with respect to the ground surface 115. In providing this additional movement while users also use the swings 112, the swing assembly 110 may provide yet another unique user experience. Further, the swing assembly 110 may also employ similar standing platforms, ceiling structures, and the like, as those shown in FIGS. 7-8, so that other users may enjoy the motion produced by the elastic resistance devices 160

It will be appreciated that the present disclosure provides polygonal swing assemblies. While only certain embodiments have been set forth, alternatives and modifications will be apparent from the above description to those skilled in the art. These and other alternatives are considered equivalents and within the spirit and scope of this disclosure and the appended claims.

INDUSTRIAL APPLICABILITY

The present disclosure relates generally to amusement assemblies and, more particularly, relates to polygonal swing assemblies. The foregoing is applicable to, but not limited to being applicable to commercial, municipal, or residential amusement equipment.

As detailed above, the swing assemblies 10, 110 may provide for unique user experiences with enhanced safety characteristics. As it is always an aim to provide the most entertainment to users of amusement assemblies, like playground equipment, such advances in amusement are always necessary. By having such polygonal swing assemblies 10, 110 users can have a unique experience by, for example, having all users swing inward towards the center point 34, without ever colliding with one another. Additionally, when additional features like the rotating assembly 50 and/or the elastic resistance devices 60, 160 are employed, additional forces can be applied to the swing assemblies 10, 110, thus, creating unique amusement experiences. Further, features like the ceiling structure 70, the standing platforms 80, and/or the restraint system 86, further inclusivity for more users can be achieved, even inclusivity for persons with disabilities.

Of course, safety is always considered when using amusement assemblies. The disclosed swing assemblies 10, 110 may provide even greater safety by blocking the paths of swings 12 between users via the outer wing structures 22, 122. The outer wing structures 22, 122 may also prevent non-using people from entering the path of the swing. Further, as the outer wing structures 22 may provide bay enclosures for swing 12 users, they may further prevent swing collisions.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A swing assembly comprising:

a base having at least three sides and defining a plurality of vertices and a center point, the plurality of vertices located at points where two of the at least three sides meet;

a plurality of vertical beams, each of the plurality of vertical beams having a first end and a second end, the first end being connected to the base at one of a plurality of beam locations, the beam locations being in proximate alignment with one of the plurality of vertices and the center point;

a plurality of horizontal beams, each of the plurality of horizontal beams extending from and connected to the second end of one of the plurality of vertical beams to the second end of another of the plurality of vertical beams;

a plurality of swings, each of the plurality of swings being attached to one of the plurality of horizontal beams; and a plurality of outer wing structures, each of the outer wing structures associated with one of the plurality of vertical beams, each of the outer wing structures extending radially outward of its respective associated vertical beam and connected to the base at a one of a plurality of wing locations, the wing locations being in proximate alignment with one of the plurality of vertices and the center point and located radially outward of the support beam location of the respective member of the plurality of vertical beams with which each outer wing structure is associated.

2. The swing assembly of claim 1, further comprising a rotating assembly including a top end and a bottom end, the rotating assembly attached to the base at the top end and connected to a ground surface at the bottom end.

3. The swing assembly of claim 2, wherein the rotating assembly is configured to rotate about a center vertical axis, the center vertical axis based on, at least, the center point.

4. The swing assembly of claim 1, further comprising a governor for limiting rotational speed of the rotating assembly.

5. The swing assembly of claim 1, further comprising an elastic resistance device, the elastic resistance device attached to the base at a top end and connected to a ground surface at a bottom end.

6. The swing assembly of claim 5, wherein the elastic resistance device includes a spring attached to the base at a location beneath the base and proximate to the center point.

7. The swing assembly of claim 5, wherein the elastic resistance device includes a plurality of springs, each of the plurality of springs being attached to the base at a location associated with one of at least three sides.

8. The swing assembly of claim 5, wherein the elastic resistance device includes a plurality of springs, each of the plurality of springs being attached to the base at a location in alignment with one of the plurality of vertices and the center point.

9. The swing assembly of claim 8, wherein each of the plurality of springs is attached proximate to and underneath the second end of a member of the plurality of vertical beams.

10. The swing assembly of claim 1, further comprising an accessibility ramp associated with one of the at least three sides.

11. The swing assembly of claim 1, wherein the base includes a restraint system configured to lock a mobility assistance device in a static position with respect to the base.

12. The swing assembly of claim 1, further comprising at least one standing platform, the at least one standing platform extending from a perimeter of the base at a location proximate to one of the plurality of vertices.

13. The swing assembly of claim 12, further comprising at least one handle associated with the at least one standing platform and disposed on a member of the plurality of wing structures.

14. The swing assembly of claim 1, further comprising:

a ceiling structure disposed above the second ends of the plurality of horizontal beams; and a plurality of steps configured to allow a user to access the ceiling structure, each of the plurality of steps being associated with one of the plurality of wing structures.

15. The swing assembly of claim 14, further comprising a barrier structure extending vertically upward from a perimeter of the ceiling structure.

16. The swing assembly of claim 1, further comprising a barrier structure associated with at least one of the outer wing structures.

17. A swing assembly comprising:

a plurality of base structures, each of the plurality of base structures connected to a ground surface and positioned radially outward of a center point at a respective radial distance from the center point, each of the respective radial distances being substantially similar, and each of the plurality of base structures positioned substantially circumferentially equidistant from one another;

a plurality of vertical beams, each of the plurality of vertical beams having a first end and a second end, the first end being connected to one of the plurality of base structures;

a plurality of horizontal beams, each of the plurality of horizontal beams extending from and connected to the second end of a member of the plurality of vertical beams to the second end of another member of the plurality of vertical beams;

a plurality of swings, each of the plurality of swings being attached to one of the plurality of horizontal beams; and a plurality of outer wing structures, each of the outer wing structures associated with one of the plurality of vertical beams, each of the outer wing structures extending radially outward of its respective associated vertical beam.

18. The swing assembly of claim 17, further comprising a plurality of elastic resistance devices, each of the elastic resistance devices associated with at least one of the plurality of base structures and providing connection between the ground surface and one of the plurality of base structures.

19. The swing assembly of claim 18, wherein at least one of the plurality of elastic resistance devices is a spring.

20. A swing assembly comprising:

a base having at least three sides and defining a plurality of vertices and a center point, the plurality of vertices located at points where two of the at least three sides meet;

a plurality of vertical beams, each of the plurality of vertical beams having a first end and a second end, the first end being connected to the base at one of a plurality of beam locations, the beam locations being in proximate alignment with one of the plurality of vertices and the center point;

a plurality of swings, each of the plurality of swings being attached to two of the plurality of vertical beams; and a plurality of outer wing structures, each of the outer wing structures associated with one of the plurality of vertical beams, each of the outer wing structures extending radially outward of its respective associated vertical beam and connected to the base at a one of a plurality of wing locations, the wing locations being in proximate alignment with one of the plurality of vertices and the center point and located radially outward of the support beam location of the respective member of the plurality of vertical beams with which each outer wing structure is associated.

* * * * *